US008973647B2

(12) United States Patent
Seo et al.

(10) Patent No.: US 8,973,647 B2
(45) Date of Patent: Mar. 10, 2015

(54) HEAT EXCHANGER AND AIR CONDITIONER HAVING THE SAME

(75) Inventors: Kang Tae Seo, Suwon-si (KR); Hayase Gaku, Seongnam-si (KR); Young Min Kim, Suwon-si (KR); Dong Ho Park, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 610 days.

(21) Appl. No.: 12/926,111

(22) Filed: Oct. 26, 2010

(65) Prior Publication Data

US 2011/0120681 A1 May 26, 2011

(30) Foreign Application Priority Data

Nov. 20, 2009 (KR) ..... 10-2009-112433

(51) Int. Cl.

| | |
|---|---|
| ***F28D 1/04*** | (2006.01) |
| ***F24F 13/30*** | (2006.01) |
| ***F28D 1/047*** | (2006.01) |
| ***F28F 1/32*** | (2006.01) |
| ***F28F 17/00*** | (2006.01) |
| *F28F 1/20* | (2006.01) |

(52) U.S. Cl.

CPC ..... *F24F 13/30* (2013.01); *F28D 1/0477* (2013.01); *F28F 1/325* (2013.01); *F28F 17/005* (2013.01)

USPC ..... 165/151; 165/181

(58) Field of Classification Search

CPC ..... F28F 2215/08; F28F 1/325; F28F 3/027; F28F 17/005; F28D 1/0477

USPC ..... 165/150, 151, 152, 181, 182

See application file for complete search history.

(56) References Cited

U.S. PATENT DOCUMENTS

| | | | | | |
|---|---|---|---|---|---|
| 4,705,105 | A | * | 11/1987 | Cur | 165/151 |
| 4,860,822 | A | * | 8/1989 | Sacks | 165/151 |
| 5,042,576 | A | * | 8/1991 | Broadbent | 165/151 |
| 5,062,475 | A | * | 11/1991 | Bemisderfer et al. | 165/151 |
| 5,360,060 | A | * | 11/1994 | Tanaka et al. | 165/151 |
| 5,722,485 | A | * | 3/1998 | Love et al. | 165/151 |
| 5,775,413 | A | * | 7/1998 | Kawanabe et al. | 165/151 |
| 5,927,393 | A | * | 7/1999 | Richter et al. | 165/151 |
| 6,786,274 | B2 | * | 9/2004 | Bemisderfer | 165/151 |

(Continued)

FOREIGN PATENT DOCUMENTS

| | | | |
|---|---|---|---|
| JP | 7-17955 | | 4/1995 |
| JP | 11-270983 | | 10/1999 |
| JP | 2004085013 | A * | 3/2004 |
| KR | 20-2009-0004438 | | 5/2009 |

OTHER PUBLICATIONS

Korean Office Action dated Dec. 27, 2013 from Korean Patent Application No. 10-2009-0112433, 5 pages.

(Continued)

*Primary Examiner* — Tho V Duong

(74) *Attorney, Agent, or Firm* — Staas & Halsey LLP

(57) ABSTRACT

A heat exchange fin in a heat exchanger is disposed between two refrigerant pipes spaced apart from each other includes a guide protrusion including first inclined planes inclined upward along opposite sides of a center line of a refrigerant pipe row in a symmetric fashion and second inclined planes inclined downward from upper ends of the first inclined planes, and the first inclined planes and the second inclined planes are provided with louver members, thereby improving heat exchange efficiency.

18 Claims, 6 Drawing Sheets

(56) References Cited

U.S. PATENT DOCUMENTS

| | | | | |
|---|---|---|---|---|
| 6,976,529 | B2 * | 12/2005 | Kester | 165/151 |
| 7,261,147 | B2 * | 8/2007 | Oh et al. | 165/151 |
| 2005/0045316 | A1 * | 3/2005 | Oh et al. | 165/166 |
| 2008/0190588 | A1 * | 8/2008 | Heidenreich et al. | 165/151 |

OTHER PUBLICATIONS

Chinese Office Action dated Jan. 24, 2014 from Chinese Patent Application No. 201010553740.X, 6 pages.

* cited by examiner

HEAT EXCHANGER AND AIR CONDITIONER HAVING THE SAME

CROSS-REFERENCE TO RELATED APPLICATIONS

This application claims the benefit of Korean Patent Application No. 2009-0112433, filed on Nov. 20, 2009 in the Korean Intellectual Property Office, the disclosure of which is incorporated herein by reference.

BACKGROUND

1. Field

Embodiments relate to a heat exchanger having heat exchange fins configured in a flow structure having high heat exchange efficiency and low pressure loss and an air conditioner having the same.

2. Description of the Related Art

Generally, a heat exchanger is an apparatus used in equipment, such as an air conditioner or a refrigerator, having a refrigeration cycle. The heat exchanger includes a plurality of heat exchange fins arranged at intervals and a refrigerant pipe extending through the heat exchange fins to guide a refrigerant. In the heat exchanger, external air passes through the heat exchange fins to perform heat exchange between the air and the heat exchange fins, thereby achieving cooling or heating.

The heat exchange efficiency of the heat exchanger may be increased or decreased according to the shape of the heat exchange fins. Also, flow resistance of internal air or external air passing through the heat exchanger may be increased or decreased according to the shape of the heat exchange fins.

Consequently, the structure of the heat exchange fins may be changed to increase the heat exchange efficiency of the heat exchanger and to unify flow distribution of air.

SUMMARY

It is an aspect to provide a heat exchanger configured in a structure to form a flow pattern having high heat exchange efficiency and low pressure loss and an air conditioner having the same.

Additional aspects will be set forth in part in the description which follows and, in part, will be apparent from the description, or may be learned by practice of the invention.

In accordance with one aspect, a heat exchanger includes a plurality of refrigerant pipes in at least one row arranged at intervals in a longitudinal direction thereof and plate-shaped heat exchange fins contacting the refrigerant pipes such that the heat exchange fins are arranged at intervals to allow air to flow therebetween, wherein each of the heat exchange fins includes a guide protrusion disposed between each two of the refrigerant pipes, the guide protrusion includes first inclined planes inclined upward along opposite sides of a center line of the refrigerant pipe row and second inclined planes inclined downward from upper ends of the first inclined planes, and the first inclined planes and the second inclined planes are provided with louver members to accelerate heat exchange with air flowing along the guide protrusion.

The guide protrusion may be provided adjacent to the refrigerant pipes with guide planes to guide flow of air introduced from an inlet side to dead zones located at rears of the refrigerant pipes.

Each of the guide planes may include an arc plane facing an outer circumference of each of the refrigerant pipes and a straight plane extending from one end of the arc plane.

Each of the heat exchange fins may be provided around the center line of the refrigerant pipe row with a flat drainage plane to drain condensed water.

Each of the heat exchange fins may be provided at opposite side edges thereof with flat anti-frost planes to delay frost formation.

The louver members provided at the second inclined planes may be disposed in a two-column structure.

The two-column louver members may be disposed adjacent to the refrigerant pipes, and the second inclined planes may have flat planes between the two-column louver members.

In accordance with another aspect, a heat exchanger includes a refrigerant pipe to guide a refrigerant and heat exchange fins contacting the refrigerant pipe such that the heat exchange fins are arranged at intervals to allow air to flow therebetween, wherein each of the heat exchange fins, disposed between two longitudinally separated refrigerant pipes, includes a flat drainage plane provided around a center line connecting centers of the refrigerant pipes to drain condensed water, flat anti-frost planes provided at opposite side edges of each of the heat exchange fins to delay frost formation, and a guide protrusion symmetric about the center line to induce three-dimensional flow of the air, the guide protrusion having convex shapes of a triangular section protruding between the flat drainage plane and the flat anti-frost planes, and wherein the guide protrusion is provided at upper and lower ends thereof with guide planes to guide flow of the air to dead zones located at rears of the refrigerant pipes, and the guide protrusion is provided at an inclined plane thereof with a louver member lengthily formed in a longitudinal direction thereof to accelerate heat exchange.

The inclined plane may include first inclined planes inclined upward along opposite sides of a center line of the refrigerant pipe row and second inclined planes inclined downward from upper ends of the first inclined planes, and the louver member may include a plurality of first louver members disposed at the first inclined planes in one column and a plurality of second louver members disposed at the second inclined planes in two columns.

Each of the guide planes may include an arc plane facing an outer circumference of each of the refrigerant pipes and a straight plane extending from one end of the arc plane.

The second louver members provided at the second inclined plane disposed at an inlet side to which air flows and the first louver members provided at the first inclined plane disposed at an outlet side from which the air flows may be inclined downward in a flow direction of the air, and the first louver members provided at the first inclined plane disposed at the inlet side and the second louver members provided at the second inclined plane disposed at the outlet side may be inclined upward in the flow direction of the air.

The flat drainage plane may have a width of about 0.1 mm to about 2 mm, each of the flat anti-frost planes may have a width of about 0.1 mm to about 2.0 mm, the guide protrusion may have a convex height of about 0.8 mm to about 1.5 mm, the louver members may have a pitch of about 0.8 mm to about 1.5 mm, and the first and second louver members may have angles of about 25 degrees to about 40 degrees to the respective inclined planes.

In accordance with another aspect, a heat exchanger includes a plurality of refrigerant pipes in at least one row arranged at intervals in a longitudinal direction thereof, plate-shaped heat exchange fins contacting the refrigerant pipes such that the heat exchange fins are arranged at intervals to allow air to flow therebetween, and a guide protrusion disposed at each of the heat exchange fins between each two of the refrigerant pipes, wherein the guide protrusion includes first inclined planes inclined upward along opposite sides of a flat drainage plane provided around a center line of the refrigerant pipe row and second inclined planes inclined downward from upper ends of the first inclined planes, the first inclined planes and the second inclined planes are provided with louver members provided in a longitudinal direction thereof such that the louver members are disposed in parallel, the louver members including first louver members disposed at the first inclined planes in one column and second louver members disposed at the second inclined planes in two columns, the guide protrusion including the first inclined planes and the second inclined planes is provided at upper and lower ends thereof with an arc plane facing an outer circumference of each of the refrigerant pipes and a straight plane extending from one end of the arc plane, and each of the heat exchange fins is provided at opposite side edges thereof adjacent to the lower ends of the second inclined planes with flat anti-frost planes to delay frost formation.

In accordance with a further aspect, an air conditioner has a heat exchanger including a refrigerant pipe to guide a refrigerant and heat exchange fins contacting the refrigerant pipe such that the heat exchange fins are arranged at intervals to allow air to flow therebetween, wherein each of the heat exchange fins, disposed between two longitudinally separated refrigerant pipes, includes a flat drainage plane provided around a center line connecting centers of the refrigerant pipes to drain condensed water, flat anti-frost planes provided at opposite side edges of each of the heat exchange fins to delay frost formation, and a guide protrusion symmetric about the center line to induce three-dimensional flow of the air, the guide protrusion having convex shapes of a triangular section protruding between the flat drainage plane and the flat anti-frost planes, and wherein the guide protrusion is provided at upper and lower ends thereof with guide planes to guide flow of the air to dead zones located at rears of the refrigerant pipes, and the guide protrusion is provided at an inclined plane thereof with a louver member lengthily formed in a longitudinal direction thereof to accelerate heat exchange.

The inclined plane may include first inclined planes inclined upward along opposite sides of a center line of the refrigerant pipe row and second inclined planes inclined downward from upper ends of the first inclined planes, and the louver member may include a plurality of first louver members disposed at the first inclined planes in one column and a plurality of second louver members disposed at the second inclined planes in two columns.

Each of the guide planes may include an arc plane facing an outer circumference of each of the refrigerant pipes and a straight plane extending from one end of the arc plane.

The second louver members provided at the second inclined plane disposed at an inlet side to which air flows and the first louver members provided at the first inclined plane disposed at an outlet side from which the air flows may be inclined downward in a flow direction of the air, and the first louver members provided at the first inclined plane disposed at the inlet side and the second louver members provided at the second inclined plane disposed at the outlet side may be inclined upward in the flow direction of the air.

The flat drainage plane may have a width of about 0.1 mm to about 2 mm, each of the flat anti-frost planes may have a width of about 0.1 mm to about 2.0 mm, the guide protrusion may have a convex height of about 0.8 mm to about 1.5 mm, the louver members may have a pitch of about 0.8 mm to about 1.5 mm, and the first and second louver members may have angles of about 25 degrees to about 40 degrees to the respective inclined planes.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
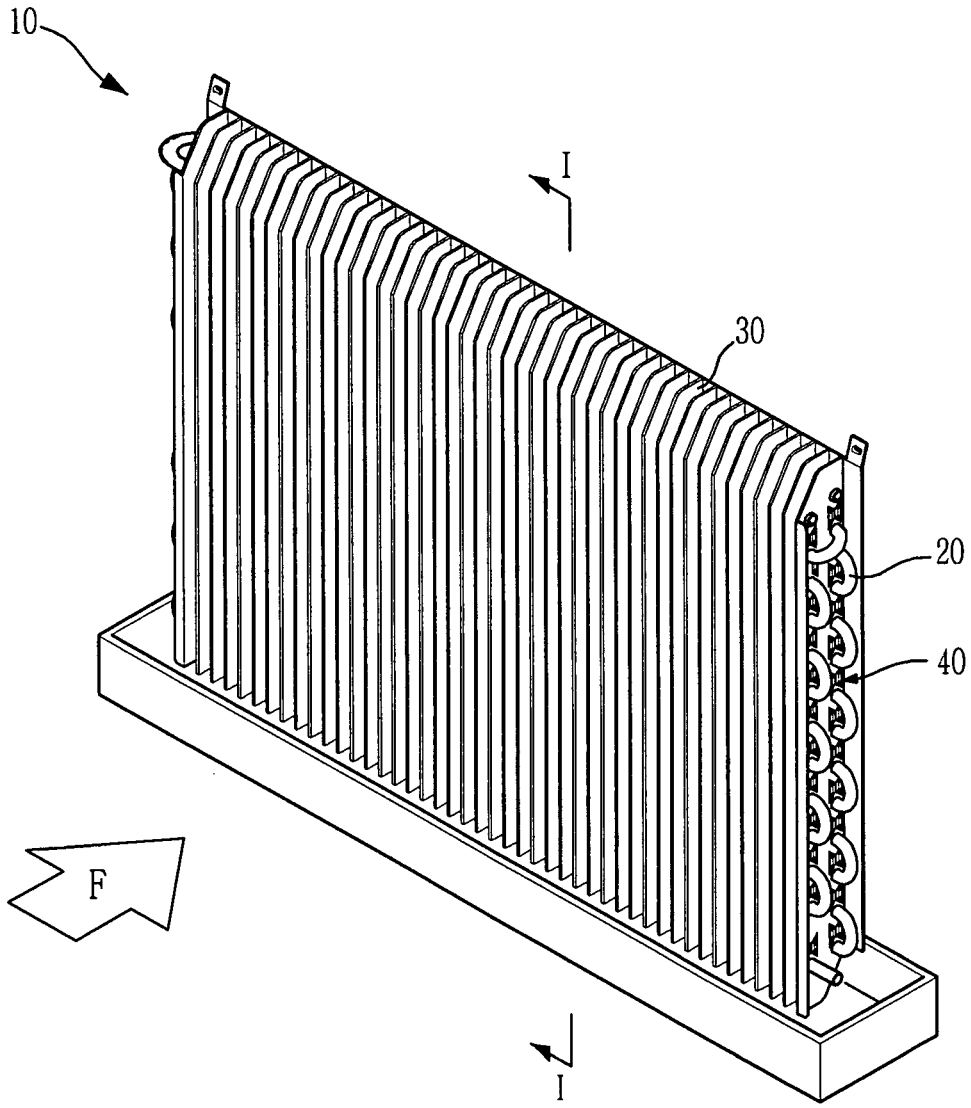
FIG. 1 is a perspective view illustrating a heat exchanger according to an embodiment.

Reference will now be made in detail to the embodiments, examples of which are illustrated in the accompanying drawings, wherein like reference numerals refer to like elements throughout.

Figure 2:
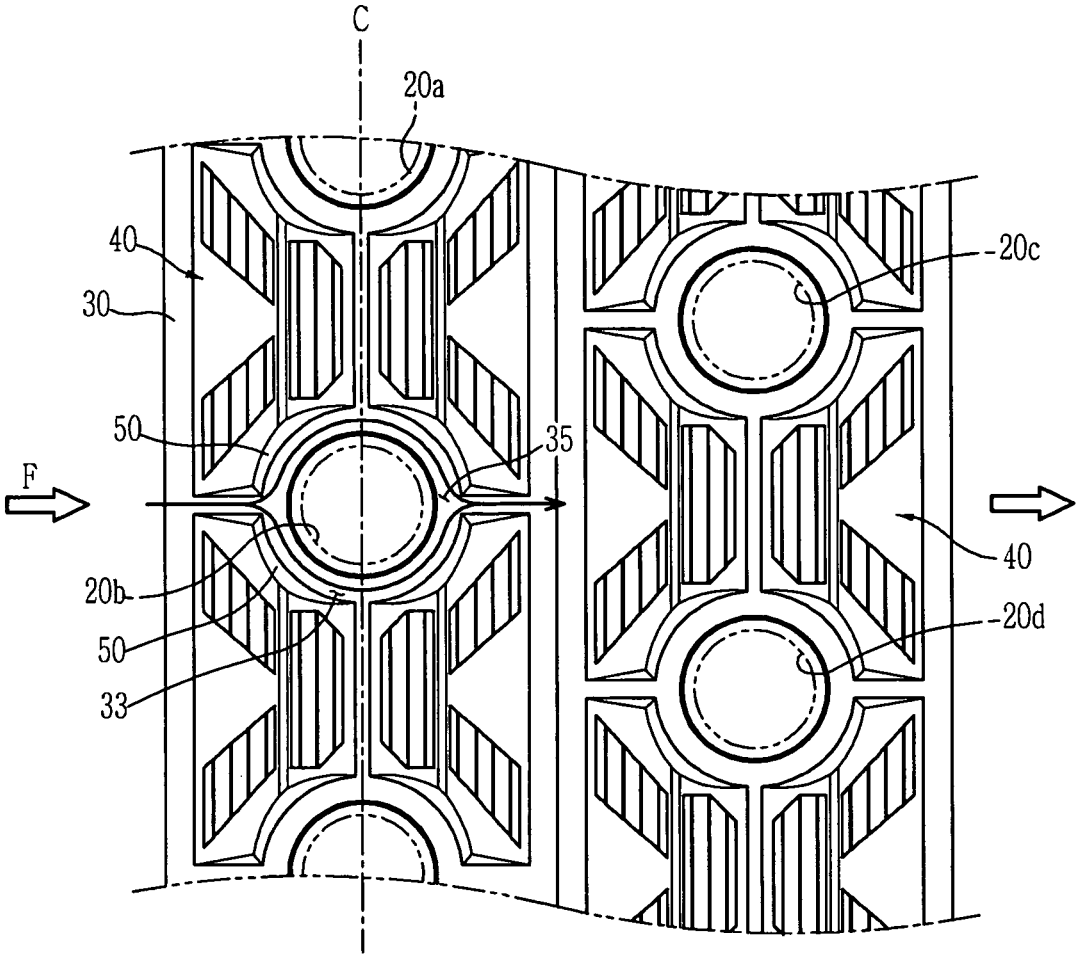
FIG. 2 is a sectional view taken along line I-I of FIG. 1.
Figure 3:
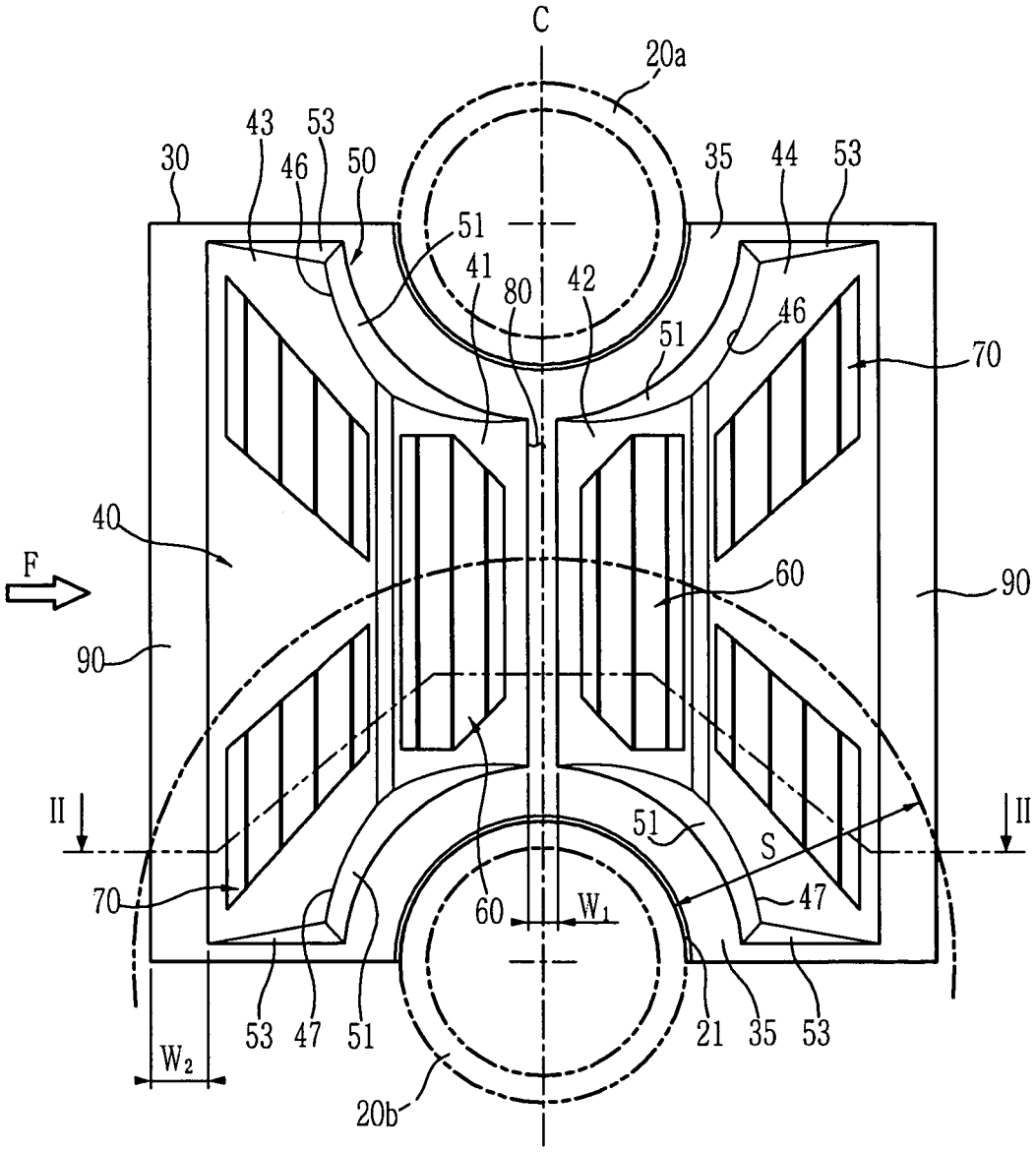
FIG. 3 is a view illustrating a heat exchange fin located between refrigerant pipes according to an embodiment.
Figure 4:
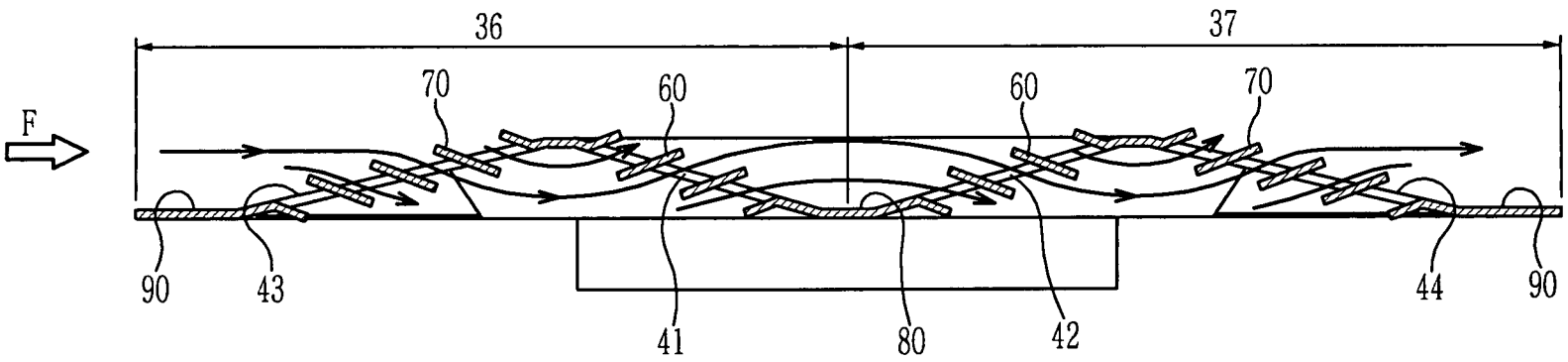
FIG. 4 is a sectional view taken along line II-II of FIG. 3.
Figure 5:
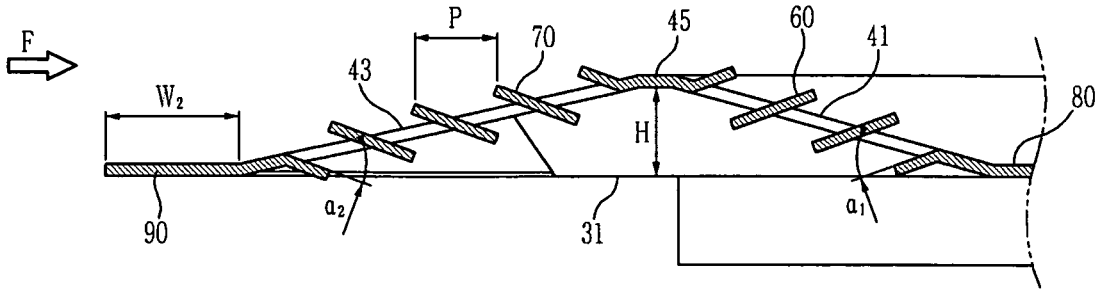
FIG. 5 is a partially enlarged sectional view of FIG. 4.

FIG. 1 is a perspective view illustrating a heat exchanger according to an embodiment. FIG. 2 is a sectional view taken along line I-I of FIG. 1. FIG. 3 is a view illustrating a heat exchange fin located between refrigerant pipes according to an embodiment. FIG. 4 is a sectional view taken along line II-II of FIG. 3. FIG. 5 is a partially enlarged sectional view of FIG. 4.

Referring to FIG. 1, a heat exchanger 10 includes a refrigerant pipe 20 to guide a refrigerant and plate-shaped heat exchange fins 30 contacting the refrigerant pipe 20 such that the heat exchange fins are arranged at predetermined intervals to allow air to flow therebetween.

The refrigerant pipe 20 is a passage through which the refrigerant flows. The refrigerant may be a chemical compound such as CFC or R-134. The refrigerant is compressed or expanded and circulated in an air conditioner (not shown) to perform cooling or heating.

The refrigerant pipe 20 may be bent several times such that the refrigerant pipe 20 may have a long length in a limited space. The refrigerant pipe 20 may contact the heat exchange fins 30.

The refrigerant pipe 20 may include first-row refrigerant pipes 20*a* and 20*b* (see FIG. 2) and second-row refrigerant pipes 20*c* and 20*d* (see FIG. 2) contacting the heat exchange fins 30. The first-row refrigerant pipes 20*a* and 20*b* and the second-row refrigerant pipes 20*c* and 20*d* may be arranged in a zigzag fashion to maximize heat exchange performance.

The heat exchange fins 30 may contact the refrigerant pipe 20. The heat exchange fins 30 may be arranged at predetermined intervals D (see FIG. 6).

Since the refrigerant pipe 20 and the heat exchange fins 30 are disposed so as to come into contact, and each of the heat exchange fins 30 has a maximum area in a limited space, heat discharging or absorbing parts are increased.

Heat of the refrigerant flowing in the refrigerant pipe 20 is transmitted to air flowing in the vicinity of the heat exchange fins 30 through the refrigerant pipe 20 and the heat exchange fins 30, with the result that the heat is easily discharged outside.

This effect is the same when heat of air flowing in the vicinity of the heat exchange fins 30 is transmitted to the refrigerant through the heat exchange fins 30 and the refrigerant pipe 20.

The plate-shaped heat exchange fins 30 are arranged in parallel to a flow direction F of air at predetermined intervals. The refrigerant pipe 20, in which the refrigerant flows, is perpendicularly fitted in the respective plate-shaped heat exchange fins 30.

Consequently, air naturally flows along the surfaces of the heat exchange fins 30 without great resistance of the heat exchange fins 30 to accelerate heat exchange.

Referring to FIG. 2, each heat exchange fin 30 is provided with a guide protrusion 40, which is located between two refrigerant pipes 20 disposed vertically to guide flow of air introduced from an inlet side thereof.

That is, on the assumption that the refrigerant pipes arranged at the first row in the flow direction F of air are first-row refrigerant pipes 20*a* and 20*b* and the refrigerant pipes arranged at the second row in the flow direction F of air are second-row refrigerant pipes 20*c* and 20*d*, the guide protrusions 40 may be provided between the first-row refrigerant pipes 20*a* and 20*b* and between second-row refrigerant pipes 20*c* and 20*d*.

The guide protrusion 40 has the same shape but different locations. Hereinafter, therefore, only the guide protrusion 40 provided at the heat exchange fin 30 between the first-row refrigerant pipes 20*a* and 20*b* will be described.

Referring to FIGS. 3 to 5, the guide protrusion 40 may be symmetric about a center line C of the refrigerant pipe row 20*a* and 20*b*.

Also, the guide protrusion 40 may have an inclined plane to guide air such that a three-dimensional flow pattern of the air is formed when the air introduced from the inlet side thereof passes through the heat exchange fin 30.

The inclined plane may include first inclined planes 41 and 42 inclined upward along opposite sides of the center line C of the refrigerant pipe row 20*a* and 20*b* and second inclined planes 43 and 44 inclined downward from the upper ends of the first inclined planes 41 and 42. Consequently, the inclined plane may have a triangular section symmetric about the center line C.

Also, a height from a bottom 31 of the heat exchange fin 30 to an edge 45 where the first inclined plane 41 or 42 and the second inclined plane 43 or 44 are connected to each other, i.e., a convex height H (see FIG. 5), is about 0.8 mm to about 1.5 mm, which provides a critical effect as compared with other ranges.

Also, the first inclined planes 41 and 42 and the second inclined planes 43 and 44 may be provided with louver members 60 and 70 to break temperature boundary layers formed along the respective inclined planes 41, 42, 43 and 44, thereby improving heat transfer performance.

That is, the first inclined planes 41 and 42 may be provided with pluralities of first louver members 60 formed by partially cutting and erecting the first inclined planes 41 and 42 to scatter air flowing along the first inclined planes 41 and 42 such that boundary layers are not grown. The second inclined planes 43 and 44 may be provided with pluralities of second louver members 70 formed by partially cutting and erecting the second inclined planes 43 and 44 to scatter air flowing along the second inclined planes 43 and 44 such that boundary layers are not grown.

The first louver members 60 provided at the first inclined planes 41 and 42 having relatively high flow rate may be lengthily provided in the longitudinal direction of the first inclined planes 41 and 42 to improve heat transfer performance. The second louver members 70 provided at the second inclined planes 43 and 44 may be disposed in a two-column structure in which the second louver members 70 are spaced apart from each other vertically.

That is, the second louver members 70 are spaced apart from each other vertically at the second inclined planes 43 and 44, and therefore, the second inclined planes 43 and 44 may have flat planes between the spaced second louver members 70. If the second louver members 70 are lengthily formed over the entirety of the second inclined planes 43 and 44 having vertically long length in the longitudinal direction of the second inclined planes 43 and 44, a ratio of heat exchange efficiency to pressure loss is low, and the stiffness of the guide protrusion 40 is reduced.

Also, when the second louver members 70 are disposed in the two-column structure, the second louver members 70 may be disposed adjacent to the refrigerant pipes 20*a* and 20*b* to efficiently discharge heat conducted from the refrigerant pipes 20*a* and 20*b*.

That is, the second louver members 70 are disposed within positions radially spaced by a predetermined distance S from semi-circumferences 21 of the respective refrigerant pipes 20*a* and 20*b*, thereby increasing a ratio of heat exchange efficiency to pressure loss.

As shown in FIG. 4, the second louver members 70 provided at an inlet side 36 may be inclined such that air flowing along the second inclined plane 43 is directed below the second inclined plane 43, and the first louver members 60 provided at the inlet side 36 may be inclined such that air flowing below the second inclined plane 43 is directed above the second inclined plane 43.

Also, the first louver members 60 provided at an outlet side 37 may be inclined in the direction opposite to the first louver members 60 at the inlet side 36, and the second louver members 70 provided at the outlet side 37 may be inclined in the direction opposite to the second louver members 70 at the inlet side 36.

The inlet side 36 indicates a side to which air flows (F) about the center line C connecting the centers of the refrigerant pipes 20*a* and 20*b*, and the outlet side 37 indicates a side from which air flows about the center line C connecting the centers of the refrigerant pipes 20*a* and 20*b*.

Consequently, air flowing in the flow direction F has a three-dimensional flow pattern with respect to the guide protrusion 40 through the first and second louver members 60 and 70, thereby improving heat transfer performance according to breakage of the boundary layers and considerably reducing pressure loss of the air.

As shown in FIG. 5, angles $\alpha 1$ and $\alpha 2$ between the first and second louver members 60 and 70 and the first and second inclined planes 41 and 43 may be 25 to 40 degrees. Also, a pitch P of the first louver members 60 and the second louver members 70 may be 0.8 to 1.5 mm.

That is, the second louver members 70 provided at the inlet side 36 and the first louver members 60 provided at the outlet side 37 may have an angle $\alpha 2$ of 25 to 40 degrees with respect to the second inclined plane 43 and the first inclined plane 42 in the clockwise direction. Also, the first louver members 60 provided at the inlet side 36 and the second louver members 70 provided at the outlet side 37 may have an angle $\alpha 1$ of 25 to 40 degrees with respect to the first inclined plane 41 and the second inclined plane 44 in the counterclockwise direction.

With the angles $\alpha 1$ and $\alpha 2$ and the pitch P defined as described above, the increase in pressure drop of air is minimized at the first and second louver members 60 and 70, and, at the same time, a heat transfer area where heat transfer is simultaneously performed is increased to increase an amount of heat discharged.

Meanwhile, as shown in FIG. 3, guide planes 50 to guide flow of air to dead zones, located at rears 35 of the refrigerant pipes 20*a* and 20*b*, where little convection is performed in the flow direction F of the air may be provided at the guide protrusion 40 adjacent to the refrigerant pipes 20*a* and 20*b*.

The guide planes 50 may be planes vertically extending from the bottom 31 of the heat exchange fin 30 to upper end edges 46 and the lower end edges 47 of the inclined planes 41, 42, 43 and 44 of the guide protrusion 40. Each of the guide planes 50 may include an arc plane 51 and a straight plane 53 symmetric about the center line C.

The arc plane 51 symmetric about the center line C is formed in the shape of an arc facing the outer circumference of each of the refrigerant pipes 20*a* and 20*b*. The straight plane 53 extending from one end of the arc plane 51 may be disposed in parallel to the flow direction F of air.

Consequently, a channel 33 to guide flow of air to the refrigerant pipes 20*a* and 20*b* is defined between the guide planes 50 of the guide protrusions 40 spaced apart from each other vertically as shown in FIG. 2, thereby reducing the dead zones formed at the rears 35 of the refrigerant pipes 20*a* and 20*b*.

Meanwhile, as shown in FIG. 3, the heat exchange fin 30 may be provided around the center line of the refrigerant pipes 20*a* and 20*b* with a flat drainage plane 80 to rapidly drain condensed water resulting from condensation of moisture in the air due to temperature difference between the refrigerant flowing in the refrigerant pipes 20*a* and 20*b* and the moisture in the air. Also, the heat exchange fin 30 may be provided at opposite side edges thereof with flat anti-frost planes 90 to delay formation of frost on the surface of the heat exchange fin 30, thereby improving efficiency.

The flat drainage plane 80 may have a width W1 of 0.1 to 2 mm. Each of the flat anti-frost planes 90 may have a width W2 of 1.0 to 2.0 mm. These ranges provide critical effects as compared with other ranges.

Figure 6:
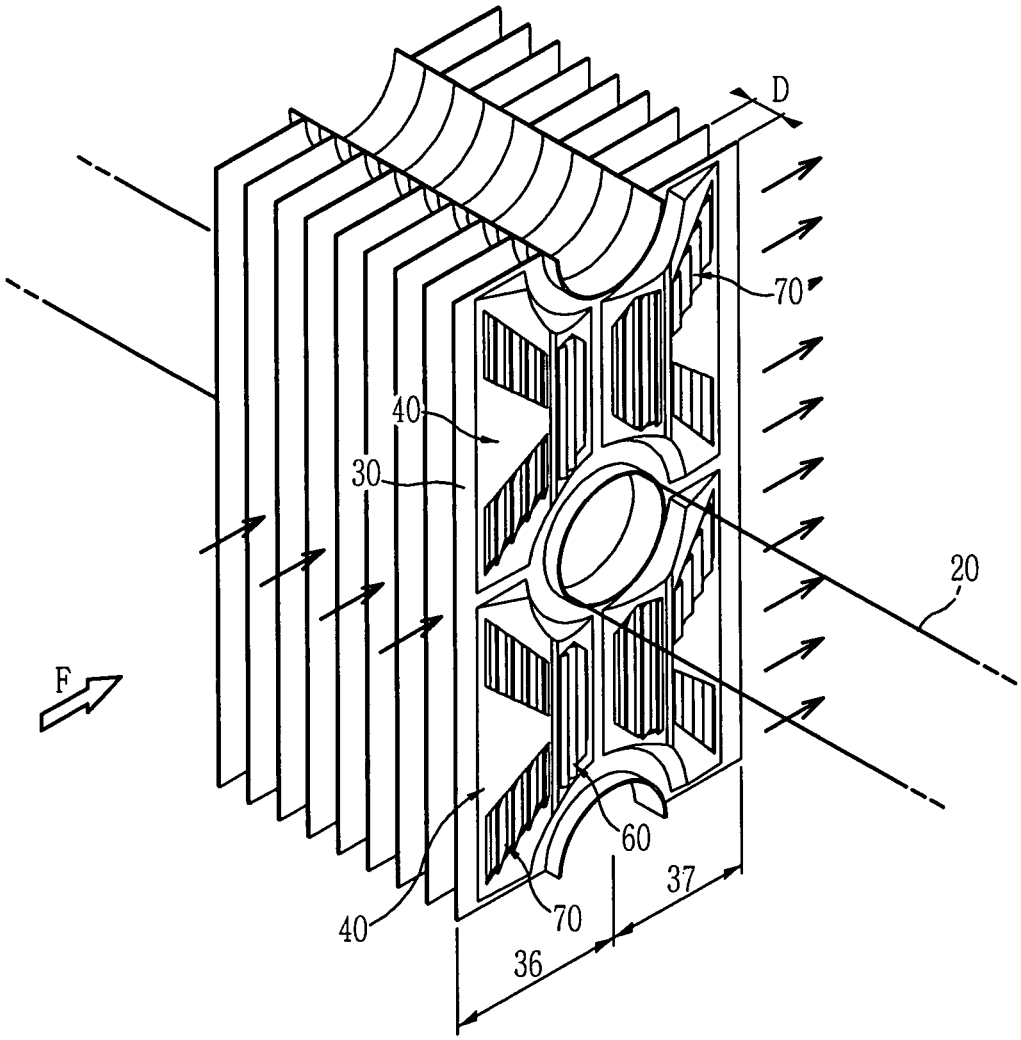
FIG. 6 is a view illustrating flow distribution of air discharged through heat exchange fins according to an embodiment.

FIG. 6 is a view illustrating flow distribution of air discharged through heat exchange fins according to an embodiment of the present invention.

When air passes through the inlet side 36 and the outlet side 37 of each heat exchange fin 30 in the flow direction F of the air, as shown in FIG. 6, the pressure loss of the air is minimized by the guide protrusion 40 of each heat exchange fin 30 and the first and second louver members 60 and 70 formed at the guide protrusion 40, which are formed within the numerical ranges of this embodiment, thereby achieving maximum heat transfer performance. Also, the flow distribution of the air discharged through the outlet side 37 is uniform, thereby achieving noise reduction.

As is apparent from the above description, the pressure loss of air is minimized and maximum heat transfer performance is achieved through three-dimensional flow of the air at the heat exchange fins.

Also, flow distribution of air at the insides and the ends of the heat exchange fins is unified, and therefore, noise is reduced.

In addition, the dead zone located at the rear of the refrigerant pipe is reduced, and therefore, heat exchange efficiency is further improved.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A heat exchanger comprising:

a plurality of refrigerant pipes in at least one row arranged at intervals in a longitudinal direction thereof and plate-shaped heat exchange fins contacting the refrigerant pipes such that the heat exchange fins are arranged at intervals to allow air to flow therebetween, wherein each of the heat exchange fins comprises a guide protrusion disposed between each two of the refrigerant pipes and wherein each of the heat exchange fins is provided around a center line of the refrigerant pipe row with a flat drainage plane to drain condensed water, wherein the guide protrusion comprises first inclined planes inclined upward along opposite sides of a center line of the refrigerant pipe row and second inclined planes inclined downward from upper ends of the first inclined planes, wherein the first inclined planes are provided with one pair of first louver members and the second inclined planes are each provided with one pair of second louver members to accelerate heat exchange with air flowing along the guide protrusion, wherein the width of the guide protrusion is significantly greater than the width of the flat drainage plane, wherein the louver members provided at the second inclined planes are disposed in a two-column structure with louver members of the same size, and wherein the one pair of second louver members are disposed along a circumferential direction with respect to a position between two refrigerant pipes adjacent to each other among the refrigerant pipes, and the one pair of second louver members are provided to be gradually spaced further apart from each other as distance from the center line increases.

2. The heat exchanger according to claim 1, wherein the guide protrusion is provided adjacent to the refrigerant pipes with guide planes to guide flow of air introduced from an inlet side to dead zones located at rears of the refrigerant pipes.

3. The heat exchanger according to claim 2, wherein each of the guide planes comprises an arc plane facing an outer circumference of each of the refrigerant pipes and a straight plane extending from one end of the arc plane.

4. The heat exchanger according to claim 1, wherein each of the heat exchange fins is provided at opposite side edges thereof with flat anti-frost planes to delay frost formation.

5. The heat exchanger according to claim 1, wherein the two-column louver members are disposed adjacent to the refrigerant pipes, and the second inclined planes have flat planes between the two-column louver members.

6. A heat exchanger comprising:

a refrigerant pipe to guide a refrigerant and heat exchange fins contacting the refrigerant pipe such that the heat exchange fins are arranged at intervals to allow air to flow therebetween, wherein each of the heat exchange fins, disposed between two longitudinally separated refrigerant pipes, comprises a flat drainage plane provided around a center line connecting centers of the refrigerant pipes to drain condensed water, flat anti-frost planes provided at opposite side edges of each of the heat exchange fins to delay frost formation, and a guide protrusion symmetric about the center line to induce three-dimensional flow of the air, the guide protrusion having convex shapes of a triangular section protruding between the flat drainage plane and the flat anti-frost planes, wherein the guide protrusion is provided at upper and lower ends thereof with guide planes to guide flow of the air to dead zones located at rears of the refrigerant pipes, and the guide protrusion is provided at an inclined plane thereof with a louver member lengthily formed in a longitudinal direction thereof to accelerate heat exchange, wherein the width of the guide protrusion is significantly greater than the width of the flat drainage plane, wherein second louver members are provided at second inclined planes and are disposed in a two-column structure with louver members of the same size, and wherein the second louver members provided at the second inclined planes are disposed along a circumferential direction with respect to a position between two refrigerant pipes adjacent to each other among the refrigerant pipes, and are provided to be gradually spaced further apart from each other as distance from the center line increases.

7. The heat exchanger according to claim 6, wherein the inclined plane comprises first inclined planes inclined upward along opposite sides of a center line of the refrigerant pipe row and second inclined planes inclined downward from upper ends of the first inclined planes, and the louver member comprises a plurality of first louver members disposed at the first inclined planes in one column.

8. The heat exchanger according to claim 7, wherein each of the guide planes comprises an arc plane facing an outer circumference of each of the refrigerant pipes and a straight plane extending from one end of the arc plane.

9. The heat exchanger according to claim 7, wherein the second louver members provided at the second inclined plane disposed at an inlet side to which air flows and the first louver members provided at the first inclined plane disposed at an outlet side from which the air flows are inclined downward in a flow direction of the air, and the first louver members provided at the first inclined plane disposed at the inlet side and the second louver members provided at the second inclined plane disposed at the outlet side are inclined upward in the flow direction of the air.

10. The heat exchanger according to claim 9, wherein the flat drainage plane has a width of about 0.1 mm to about 2 mm, each of the flat anti-frost planes has a width of about 1.0 mm to about 2.0 mm, the guide protrusion has a convex height of about 0.8 mm to about 1.5 mm, the louver members have a pitch of about 0.8 mm to about 1.5 mm, and the first and second louver members have angles of about 25 degrees to about 40 degrees to the respective inclined planes.

11. A heat exchanger comprising:

a plurality of refrigerant pipes in at least one row arranged at intervals in a longitudinal direction thereof;

plate-shaped heat exchange fins contacting the refrigerant pipes such that the heat exchange fins are arranged at intervals to allow air to flow therebetween; and a guide protrusion disposed at each of the heat exchange fins between each two of the refrigerant pipes, wherein the guide protrusion comprises first inclined planes inclined upward along opposite sides of a flat drainage plane provided around a center line of the refrigerant pipe row and second inclined planes inclined downward from upper ends of the first inclined planes, wherein the first inclined planes and the second inclined planes are provided with louver members provided in a longitudinal direction thereof such that the louver members are disposed in parallel, the louver members comprising first louver members disposed at the first inclined planes in one column and second louver members disposed at the second inclined planes in two columns, wherein the guide protrusion comprising the first inclined planes and the second inclined planes is provided at upper and lower ends thereof with an arc plane facing an outer circumference of each of the refrigerant pipes and a straight plane extending from one end of the arc plane, wherein each of the heat exchange fins is provided at opposite side edges thereof adjacent to the lower ends of the second inclined planes with flat anti-frost planes to delay frost formation, wherein the width of the guide protrusion is significantly greater than the width of the flat drainage plane, wherein the louver members provided at the second inclined planes are disposed in a two-column structure with louver members of the same size, and wherein the louver members provided at the second inclined planes are disposed along a circumferential direction with respect to a position between two refrigerant pipe adjacent to each other among the refrigerant pipes, and are provided to be gradually spaced further apart from each other as distance from the center line increases.

12. An air conditioner comprising:

a heat exchanger comprising a refrigerant pipe to guide a refrigerant and heat exchange fins contacting the refrigerant pipe such that the heat exchange fins are arranged at intervals to allow air to flow therebetween, wherein each of the heat exchange fins, disposed between two longitudinally separated refrigerant pipes, comprises a flat drainage plane provided around a center line connecting centers of the refrigerant pipes to drain condensed water, flat anti-frost planes provided at opposite side edges of each of the heat exchange fins to delay frost formation, and a guide protrusion symmetric about the center line to induce three-dimensional flow of the air, the guide protrusion having convex shapes of a triangular section protruding between the flat drainage plane and the flat anti-frost planes, wherein the guide protrusion is provided at upper and lower ends thereof with guide planes to guide flow of the air to dead zones located at rears of the refrigerant pipes, and the guide protrusion is provided at an inclined plane thereof with a louver member lengthily formed in a longitudinal direction thereof to accelerate heat exchange, wherein the width of the guide protrusion is significantly greater than the width of the flat drainage plane, wherein second louver members are provided at the second inclined planes and are disposed in a two-column structure with louver members of the same size, and wherein the second louver members provided at the second inclined planes are disposed along a circumferential direction with respect to a position between two refrigerant pipe adjacent to each other among the refrigerant pipes, and are provided to be gradually spaced further apart from each other as distance from the center line increases.

13. The air conditioner according to claim 12, wherein the inclined plane comprises first inclined planes inclined upward along opposite sides of the center line of the refrigerant pipe row and second inclined planes inclined downward from upper ends of the first inclined planes, and the louver member comprises a plurality of first louver members disposed at the first inclined planes in one column.

14. The air conditioner according to claim 13, wherein each of the guide planes comprises an arc plane facing an outer circumference of each of the refrigerant pipes and a straight plane extending from one end of the arc plane.

15. The air conditioner according to claim 13, wherein the second louver members provided at the second inclined plane disposed at an inlet side to which air flows and the first louver members provided at the first inclined plane disposed at an outlet side from which the air flows are inclined downward in a flow direction of the air, and the first louver members provided at the first inclined plane disposed at the inlet side and the second louver members provided at the second inclined plane disposed at the outlet side are inclined upward in the flow direction of the air.

16. The air conditioner according to claim 15, wherein the flat drainage plane has a width of about 0.1 mm to about 2 mm, and each of the flat anti-frost planes has a width of about 1.0 mm to about 2.0 mm.

17. The air conditioner according to claim 15, wherein the guide protrusion has a convex height of about 0.8 mm to about 1.5 mm.

18. The air conditioner according to claim 15, wherein the louver members have a pitch of about 0.8 mm to about 1.5 mm, and the first and second louver members have angles of about 25 degrees to about 40 degrees to the respective inclined planes.

* * * * *